United States Patent [19]

Borodulin et al.

[11] Patent Number: 4,607,626

[45] Date of Patent: Aug. 26, 1986

[54] EXPANDABLE URETHRAL BOUGIE COMPRISING BENDABLE RODS WITH RECIPROCATING DRIVER

[76] Inventors: German Borodulin, 2518 Clement St. #4, San Francisco, Calif. 94121; Maxim Persidsky, 35 Temescal St., San Francisco, Calif. 94118; Alexander Shkolnik, 4434 Fulton St. #2, San Francisco, Calif. 94121

[21] Appl. No.: 778,760

[22] Filed: Sep. 23, 1985

Related U.S. Application Data

[63] Continuation-in-part of Ser. No. 621,842, Jun. 18, 1984, abandoned.

[51] Int. Cl.[4] ..... A61H 1/00

[52] U.S. Cl. ..... 128/43; 128/303.11; 128/343; 128/345; 604/105

[58] Field of Search ..... 128/60, 43–44, 128/51–52, 79, 303.11, 311, 303 R, 341, 343, 344, 345; 604/104–109, 14, 22, 264, 274, 280, 283

[56] References Cited

U.S. PATENT DOCUMENTS

| | | | |
|---|---|---|---|
| 1,191,683 | 7/1916 | Finley | 604/107 |
| 3,495,586 | 2/1970 | Regenbogen | 128/345 |
| 3,741,214 | 6/1973 | Tillander | 128/341 |
| 4,043,338 | 8/1977 | Homm et al. | 604/105 |
| 4,154,242 | 5/1979 | Termanini | 604/105 |
| 4,432,758 | 2/1984 | Finegold | 604/104 |
| 4,535,759 | 8/1985 | Polk et al. | 128/343 |

FOREIGN PATENT DOCUMENTS

| | | | |
|---|---|---|---|
| 73751 | 9/1917 | Austria | 128/345 |
| 458663 | 4/1928 | Fed. Rep. of Germany | 128/345 |
| 640126 | 12/1936 | Fed. Rep. of Germany | 604/105 |
| 185899 | 9/1887 | France | 128/341 |
| 520263 | 6/1921 | France | 604/105 |
| 265400 | 11/1929 | Italy | 128/345 |

*Primary Examiner*—E. H. Eickholt

*Attorney, Agent, or Firm*—David Pressman

[57] ABSTRACT

A mechanically-expandable instrument (bougie), especially useful for treating diseases in the urethra and the neck of the urinary bladder, comprises an adjustable-speed driving unit (20) and a probe (22) composed of two rods (64) and (66) pivotally connected together at one end thereof and attached to output sliders (54, 56) of the driving unit at their other ends. Each of the rods (64) and (66) has a semicircular cross section so that in an assembled state the probe has a complete circular cross section. Reciprocations of the sliders cause expansions and contractions of the probe, thereby to stretch urethral constrictions in the radial direction and to subject the urethra and its the surrounding tissue to massaging and vibrational actions which are extremely efficient for treating diseases of the urethra and the neck of the urinary bladder. Other embodiments of the rod employ cams, wedges, and threaded means for creating radial expansions and contractions of the probe.

12 Claims, 17 Drawing Figures

EXPANDABLE URETHRAL BOUGIE COMPRISING BENDABLE RODS WITH RECIPROCATING DRIVER

This invention is a continuation-in-part of application Ser. No. 621842, 6/18/84, now abandoned.

BACKGROUND—FIELD OF THE INVENTION

The present invention relates to medical instruments, particularly to urological probes (bougies) for treating diseases of the urethra and the neck of the urinary bladder.

BACKGROUND—DESCRIPTION OF THE PROBLEM AND PRIOR ART

Urethral strictures, which occur in urological practice, are stable constrictions of the urethra formed by cicatrical replacement of tissues (scarring) of the urethra and surrounding fat. Urethral strictures may be of a congential nature, or may be acquired, e.g., after inflammation or injury.

Such strictures, especially postraumatic ones, are very dense, rigid, and resistant to stretching. They are localized mostly in the membranous or bulbous parts of the urethra.

A non-surgical method for treating urethral strictures is known as bougiurage, a procedure which is carried out by probing such strictures to enlarge them, such probing being done with the use of instruments known as bougies.

Conventional bougies, shown, e.g., in the text *Urology,* 3rd ed., V1, p. 242, M. F. Campbell and J. H. Harrison, eds. (Saunders, 1970) comprise a solid metal (or plastic) rod which is shaped to accommodate the physiological curvature of the urethra. Since in males the urethra's outer part is within the pendulus of penis, which is highly flexible, such outer part can be bent or straightened as necessary. The urethra's inner part extends around (behind) the pubic articulation and thus is curved. Thus conventional bougies, extending from their handle, generally comprise a straight portion followed by a curved portion adjacent the tip. This shape corresponds to the urethra when the penis is straightened, i.e., starting at its penile outlet, the urethra is straight and then curved (roughtly C-shaped).

Despite the correspondence in shapes, the insertion of a conventional bougie in males is a very complicated and painful operation, requiring high skill and concentration. Usually the urologist will employ a set of bougies of gradually increasing diameters. The results of treatment with such instruments are not always positive; complications such as bleeding, injuries, urinary fever, prostatitis, epididymitis, urethremorrhagia, etc., may occur. Even in females, whose uretheas are shorter and straighter, many of these difficulties are encountered.

Moreover the conventional bougie is used only for dilatation and cannot be utilized for other types of treatment, e.g., inner massage of the urethra and/or neck of the urinary bladder, and dilatation of nephrostomic fistulae.

OBJECTS AND ADVANTAGES OF THE PRESENT INVENTION

Accordingly one main object of the present invention is to provide an improved bougie for treating strictures. Other objects are to provide an improved bougie for treating urinary bladder neck diseases and impotence. Further objects are to provide bougies which can be used more efficiently and universally, which are more reliable in operation, and which are adjustable and simple to manufacture. Still further objects are to provide a bougie which can be used singly, which is less painful for the patient during treatment, and which causes fewer injuries or complications. Yet further objects are to provide bougies of a reduced diameter so that insertion into the urethra is facilitated, to provide bougies which can massage and provide desirable vibrational effects on urethral strictures, their surrounding tissue and the neck of the bladder, to provide bougies which can be used for dilatation of nephrostomic fistulae, and to provide expandable instruments. Other advantages of the present invention will become apparent from a consideration of the ensuing description and drawings.

Figure 1:
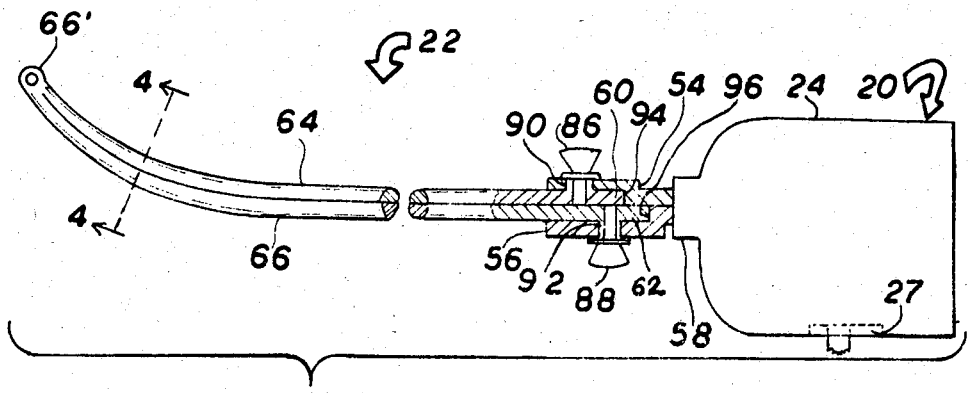
FIG. 1 is a general side, partially-sectional view of a mechanically-driven bougie of the invention.

| Reference Numerals | |
|---|---|
| 20 - drive unit | 22 - probe |
| 24 - housing | 27 - sliding knob |
| 54 - slider | 56 - slider |
| 58 - guide portion | 60, 62 - recesses |
| 64, 66 - rods | 66' - pivot pin |
| 68, 70 - shank portions | 72 - slot |
| 74 - protruding portion | 78, 80 - mating surfaces |
| 82, 84 - through holes | 86, 88 - screws |
| 90, 92 - holes | 94, 96 - stop surfaces |
| 100 - probe | 102 - tip |
| 104, 106 - cams | 108, 110 - rods |
| 130 - probe | 132, 134 - rods |
| 136, 136' - recesses | 138, 138' - wedges |
| 140 - core | 142 - recess |
| 144, 146 - grooves | 148 - nut |
| 150 - threaded portion | 152 - hole |
| 154 - handle | 156 - bolt |
| 158, 158' - cams | 160 -core |
| 162, 164 - rods | |

-continued

| Reference Numerals | |
|---|---|
| 200 - bougie | 202, 204 - rods |
| 206 - pivot pin | 208, 210 - longitudinal grooves |
| 212, 214 - inner surfaces | 216, 218 - holes |
| 220 - thread | 222 - non-threaded portion |
| 224 - shoulder | 225 - large-diameter portion |
| 226 - core element | 228 - wedge portion |
| 230, 232 - lobes | 234 - collar |
| 236 - thread | 238 - nut |
| 240 - sleeve | 242 - inner threading |
| 242a - opening | |

FIG. 1—MECHANICALLY-EXPANDABLE BOUGIE

Figure 2:
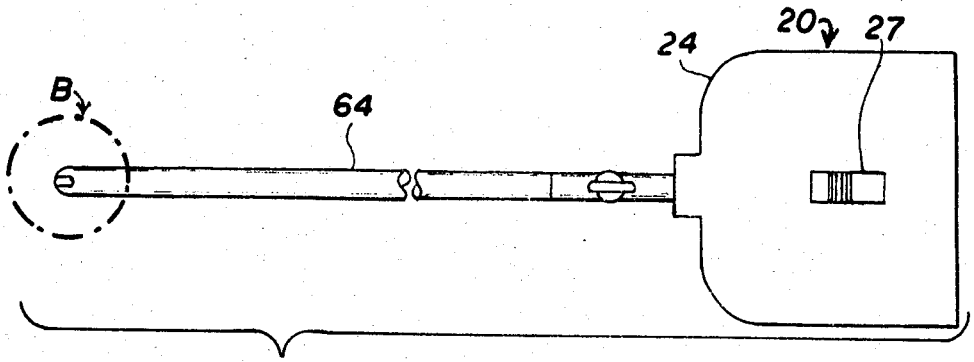
FIG. 2 is a general plan view of the bougie of FIG. 1.

According to one embodiment of the invention, a bougie is provided with a mechanically-expandable probe. As shown in FIGS. 1 and 2, the bougie consists generally of two main units, i.e., a drive unit 20 and a probe 22 which is attached to drive unit 20 in a manner described in detail below.

Drive unit 20 may be a conventional commercially available device, such as a drive unit for an electric knife with two blades which reciprocate in opposite directions. Unit 20 includes a housing 24 with an electric motor (not shown) and a supply cord (not shown) for connection to a conventional electric power source (not shown), preferably a storage battery, to prevent electric injuries in case of shorts and patient grounding. The rotational speed of the motor may be adjusted, e.g., by means of a sliding knob 27 which controls a speed control (not shown).

Figure 7:
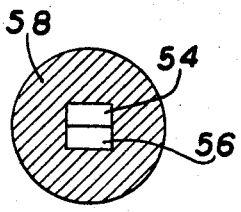
FIG. 7 is a cross-sectional view along lines 7—7 in FIG. 1.

Unit 20 has two output sliders 54 and 56 which protrude from a tubular output end 58 of housing 24 (FIG. 7). When the instrument is operated, sliders 54 and 56 reciprocate in opposite directions, their speed being controlled by knob 27. Housing 20 may also include stroke-length adjustment means (not shown). The sliders have recesses 60 and 62, respectively (FIG. 1), for receiving the shank portions of probe 22, which will be now described.

Figure 8:
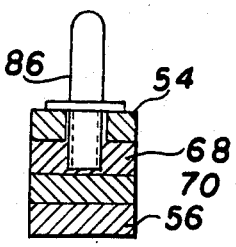
FIG. 8 is a cross-sectional view along lines 8—8 in FIG. 1.

Probe 22, the insertable part of the bougie, consists of two flexible, tapering rods 64 and 66 of semicircular cross sections (FIG. 4), except for their shank portions 68 and 70 which are thicker and more rigid and which have rectangular cross sections, as shown in FIG. 8, so as to be accommodated in rectangular recesses 60 and 62 of sliders 54 and 56, respectively.

Preferably rods 64 and 66 are made of stainless steel and are about 30 mm long and 4.5 mm in diameter.

Figure 5:
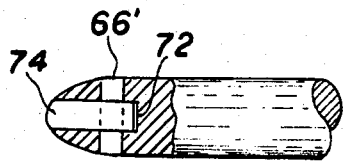
FIG. 5 is an enlarged view of element B of FIG. 2.

The front ends of rods 64 and 66 are pivotally connected to each other by a pivot pin 66'. As shown in FIG. 5, which is an enlargement of area B of FIG. 2, either rod 64 or rod 66 has a fork-shaped end with a slot 72. A protruding portion 74 of the complementary rod is inserted into this slot so that both rods 64 and 66 can be pivotally interconnected by a pin 66'.

Figure 4:
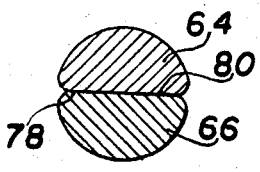
FIG. 4 is a cross-sectional view along lines 4—4 of FIG. 1.

As shown in FIG. 4, in a folded or working state, both rods 64 and 66 form a complete circle when seen in cross section, except for chamfered or rounded edges at opposite sides of on mating surfaces 78 and 80; these prevent pinching of mucosa during operation of the tool. The front end of probe 22 is also rounded. Thus in its working or folded state, the probe corresponds in its shape to a conventional bougie. However, it is made smaller in diameter than a conventional bougie because it has a capacity to expand, as explained infra. In fact it corresponds in size to the smallest bougie of a conventional set and thus can be easily inserted into the urethra. Moreover it can act inside the urethra as or more efficiently as the longest diameter bougie in a conventional set due to its ability to provide vibrational and massaging effects to strictures and their surrounding tissue. Also, as with a conventional bougie, it has a diameter which gradually narrows and flattens towards the tip so as to facilitate insertion.

Figure 3:
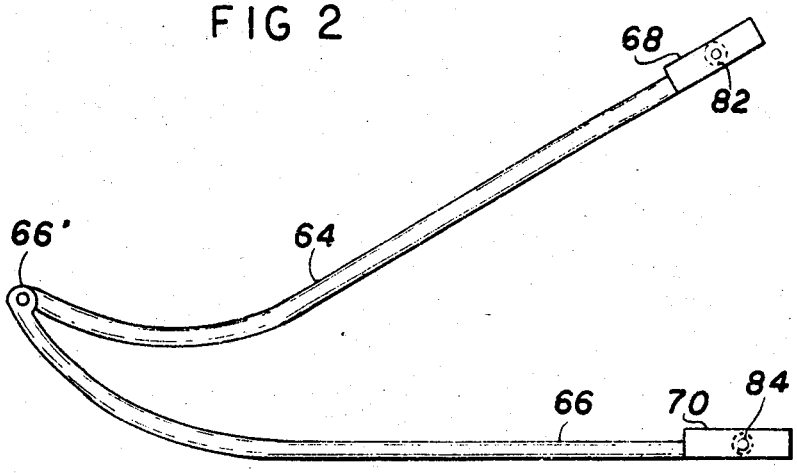
FIG. 3 is a view of a probe of the bougie of FIG. 1.

In its rectangular shank portions 68 and 70, rods 64 and 66 are provided with threaded holes 82 and 84 (FIG. 3). Screws 86 and 88 are threaded through holes 82 and 84 and mate with corresponding holes 90 and 92 in the protruding portions of sliders 54 and 56. These screws and holes are used for attachment of rods 64 and 66 to their respective sliders. In recesses 60 and 62 of the sliders, stop surfaces 94 and 90 are provided. The ends of shank portions 68 and 70 rest against these stops in order to align threaded holes 82 and 84.

Probe 22 can be made of any suitable material which is durable, flexible, and hygienically acceptable for sterilization and insertion into the urethra. For example, it can be made of stainless steel or plastic, such as polycarbonate, PFTE, etc.

FIGS. 1 TO 8—OPERATION

The bougie of FIGS. 1 to 8 operates in the following manner.

Probe 22 is folded and is attached to drive unit 20 by means of screws 86 and 88. For this purpose, shank portions 68 and 70 are pressed against stop surfaces 94 and 96 of respective sliders 54 and 56, whereupon threaded holes 82 and 84 will be aligned with holes 90 and 92 of the sliders. Each shank is attached to its corresponding slider by screws 86 and 88, respectively.

For treating a patient, e.g., for dilating a stricture in the urethra, probe 22 is inserted into urethra of the patient in the usual manner with the motor of drive unit 20 still off. This procedure is made less painful and less dangerous because of the smaller diameter of bougie 22.

When the expandable part of probe 22 reaches the constricted portion of the urethra, the motor of driving unit 20 is turned on. When the motor rotates, sliders 54 and 56 will reciprocate in mutually opposite directions.

As a result of their mutually opposite reciprocations, their flexibility, and their tip attachment by pivot pin 66', the front portions of rods 64 and 66, which are highly flexible due to their reduced diameter, will be repeatedly forced to separate from each other. I.e., they will repeatedly assume the separated positions shown in FIG. 6 and then contract, thereby expanding and contracting probe 22 radially.

Figure 6:
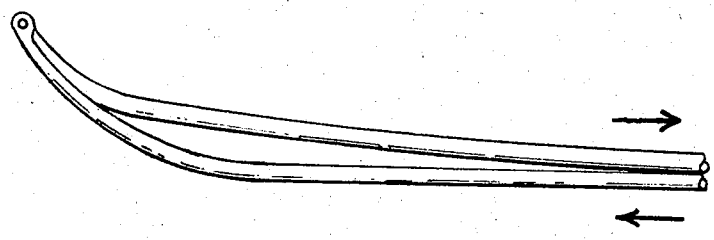
FIG. 6 is a working portion of the bougie of FIG. 1 in an expanded position.

Specifically, when the upper rod is pulled back toward the motor and the lower rod is pushed forward as indicated in FIG. 6, the upper rod will tend to shorten and thus remain straight. However the pushed lower rod, being fixed at its distal tip by reason of its connection to the lower rod and being pushed out from its proximal end, will tend to lengthen and thus will bow out at its most flexible free part, i.e., near its tip.

Thereafter lower rod 66 will be pulled back and upper rod 64 pushed out, causing both rods to straighten, and then causing the lower rod to bow and the upper rod to straighten (not shown), and so on.

These expansions and contractions will occur at a frequency controlled by knob 27 on the housing of driving unit 20. The frequency is selected according to the type of treatment being given to the patient (dilation of the stricture, massage of the urethra, massage of the neck of the bladder, etc.), but usually it should be within the limits of from 5 to 60 Hz, preferably, from 10 to 30 Hz. The duration of treatment also can vary, depending on many factors, such as the type of disease, condition of the patient, etc.

When the procedure is over, the motor is turned off and probe 22 is extracted from the urethra. After extraction, the actuating tool is disconnected from drive unit 20, sterilized, and is ready for reuse.

FIG. 9—BOUGIE WITH OVERRIDING CAMS

Figure 9:
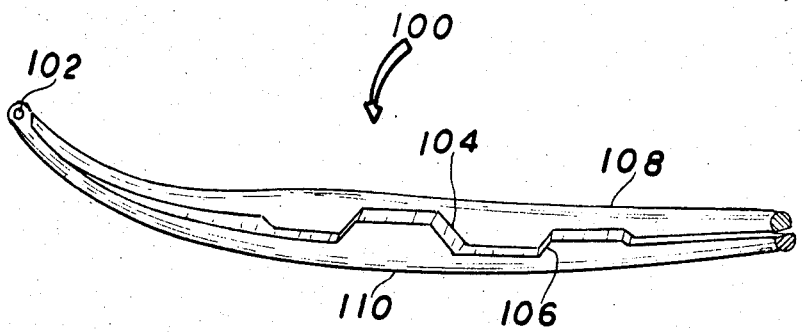
FIG. 9 is a side view of a bougie according to a second embodiment of the invention.

In some patients urethral constrictions may have a considerable length. For treating such patients, the tool of FIG. 9, which uses overriding cams, is most suitable.

The mechanically-driven tool of this embodiment has the same drive unit 20 as used in the embodiment of FIGS. 1 and 2 and differs only in its probe 100.

Probe 100 has two rods 108 and 110. At its proximal portion, remote from tip 102, mutually engaging cams 104 and 106 are formed on the mating surfaces of rods 108 and 110.

During operation of the tool, rods 108 and 110 reciprocate in mutually opposite directions. This causes cam 104 of rod 108 to override cam 106 of rod 110, causing the rods to expand in the vicinity of the tip portion and in the region of cams 106 and 104. Thus a longer portion of the probe expands and contracts, enabling a longer portion of the urethra to be treated. The insertion, control, and extraction of the tool are carried out in the same manner as has been described for the first embodiment of the invention.

FIGS. 10 AND 11—MANUALLY-ROTATABLE BOUGIE WITH WEDGES

Figure 10:
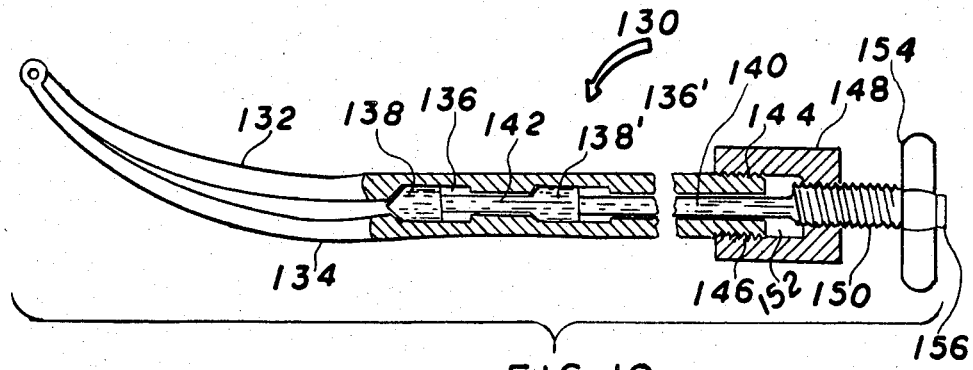
FIG. 10 is a longitudinal partially-broken view of a bougie according to a third embodiment of the invention.
Figure 11:
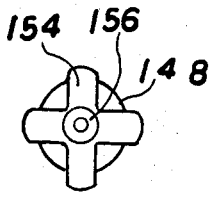
FIG. 11 is a view taken in the direction of arrow 11 in FIG. 10.

A third embodiment of a manually-driven mechanically-expandable bougie is shown in FIGS. 10 and 11. FIG. 10 is a longitudinal, partially-broken-away view of a probe 130. As in the previous modification, probe 130 consists of a pair of pivotally interconnected rods 132 and 134 of a semicircular cross-section which together form a complete circle. Recesses 136 and 136' are formed in the respective rods so that in an assembled state, these recesses form closed cavities which accommodate cams or wedges 138 and 138', respectively. Wedges 138 and 138' are attached to a rigid core or rod 140 which passes through a smaller diameter recess 142 formed between rods 132 and 134.

The rear end of core 140 protrudes outside probe 130. The rear ends of rods 132 and 134 have grooves 144 and 146 which cooperate to form a complete thread when the bougie is assembled. A nut 148 is screwed onto this thread in order to fix the proximal end of the bougie and at the same time to provide a handle for a urologist who uses the bougie. The shape of this handle is shown in FIG. 11, a view taken in the direction of arrow 11 in FIG. 10.

The protruding end of core 140 is threaded at 150 so that it can mate with the inner thread in the hole 152 of nut 148 through which core 140 protrudes. The rear end of core 140 is provided with a handle 154 rigidly attached thereto, e.g., by a bolt 156.

In operation, bougie 130 is inserted into the urethra in a conventional manner and then is expanded mechanically by rotating handle 154 in the direction which provides forward movement of wedges 138 and 138'. In the course of its forward movement, the wedges will cause rods 132 and 134 to move apart, thereby increasing the diameter of the probe Handle 154 is repeatedly rotated in forward and reverse direction for periodically expanding and constricting the probe, thereby to impart a massaging action to the surrounding tissue of the urethra.

FIGS. 12 AND 13—MANUALLY-OPERABLE BOUGIE WITH ROTATABLE CAMS

Figure 12:
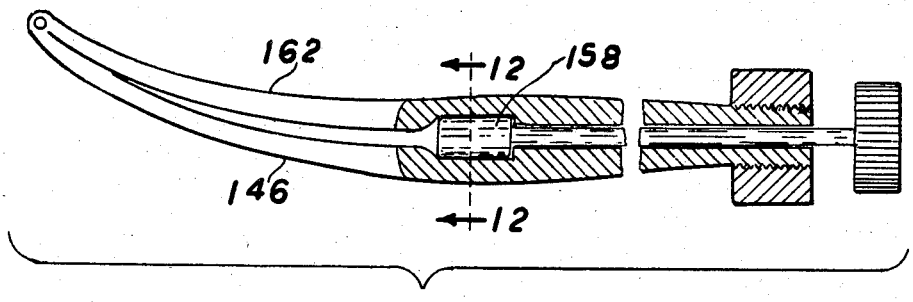
FIG. 12 is a view of a bougie according to a fourth embodiment of the invention.
Figure 13:
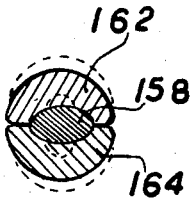
FIG. 13 is a cross-sectional view along lines 12—12 in FIG. 12.

FIGS. 12 and 13 illustrate a fourth embodiment of a bougie of the invention. This embodiment is generally similar to the embodiment shown in FIGS. 10 and 11, but differs in that a rotatable cam or eccentric 158 is are attached to a core 160 instead of reciprocating wedges 138, 138'.

During manual forward and reverse rotation, cams 158 will rotate, causing semicircular rods 162 and 164 to expand, periodically assuming the positions shown by the broken lines in FIG. 13.

FIGS. 14 TO 17—BOUGIE WITH ONE THREADED ROD

Another embodiment of a mechanically expandable bougie of the present invention is shown in FIGS. 14–17.

Figure 14:
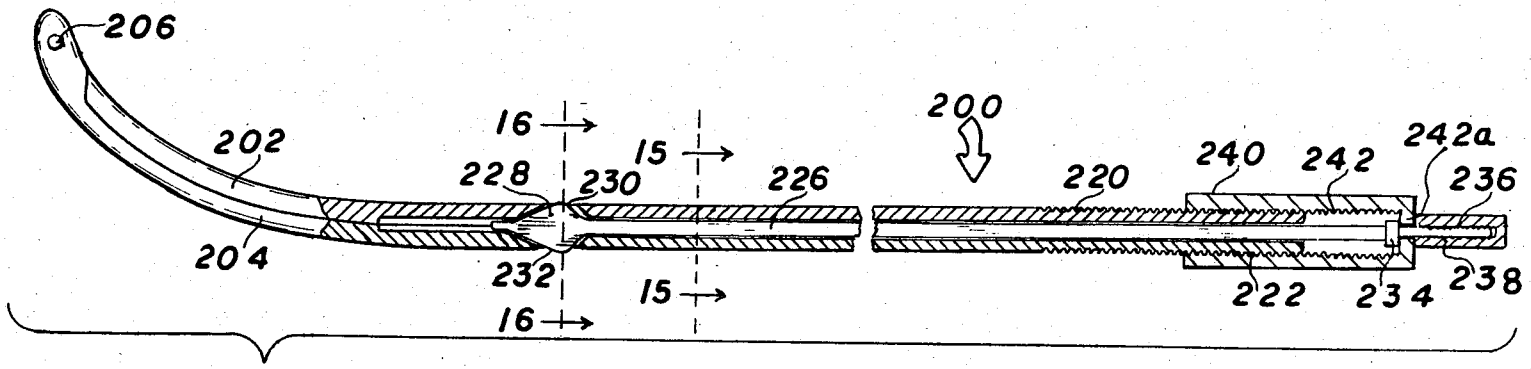
FIG. 14 shows a cross-sectional view of a bougie according to a fifth embodiment of the Invention.

FIG. 14 is a longitudinal sectional view of a bougie 200. It consists of a pair of rods 202 and 204 pivotally connected at the front end by means of a pivot pin 206.

Figure 16:
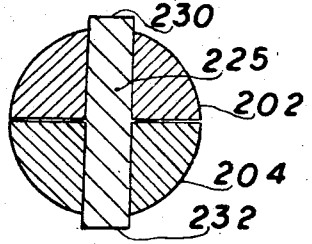
FIGS. 15 and 16 show cross-sectional views taken along the lines 15—15 and 16—16 of FIG. 14.
Figure 15:
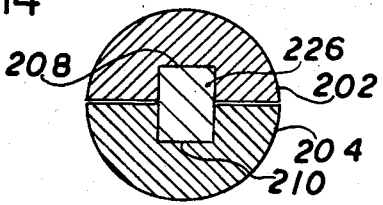

FIGS. 15 and 16, are cross-sectional views along lines 15—15 and 16—16 respectively of FIG. 14 showing both rods having a semicircular cross-sections so that in an assembled state of the bougie they form a complete circle.

Figure 17:
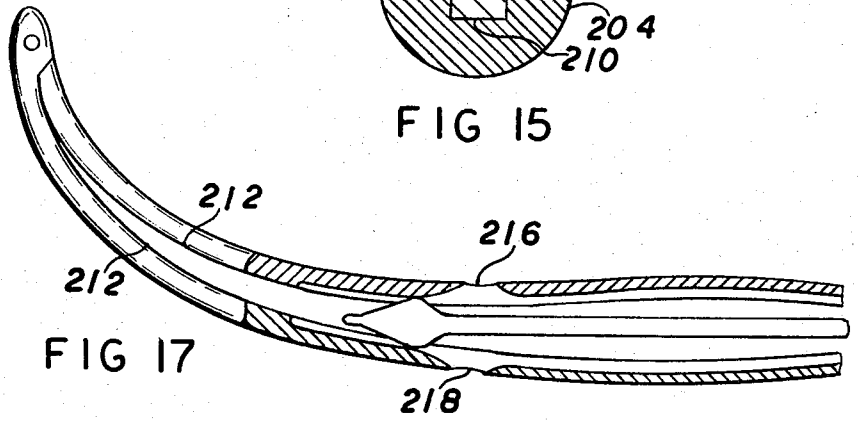
FIG. 17 shows a partial sectional view of the bougie of FIG. 14 in an expanded condition.

FIG. 17 is a view similar to FIGH. 14 showing wedge lobes displaced from holes 216,218 of the bougie.

Longitudinal grooves 208 and 210 are formed on mating inner surfaces 212 and 214 (FIG. 15) of the rods. Aligned holes 216 and 218 (FIG. 17) are provided at the front portion of the bougie i.e., at a distance from $\frac{1}{8}$ to $\frac{1}{3}$ of the length of the rods from the point of their pivotal interconnection. These holes are formed from the bottoms of respective grooves 2058 and 210 to the peripheries of the respective rods.

Grooves 208 and 210 are shallower at the portion between the front end of the bougie, ahead of holes 216 and 218, than behind these holes.

The rear end of rod 202 is threaded at 220. The other rod, 204, is not threaded at its rear end 222, but rather has a smaller diameter than the inner diameter of threads 220. A shoulder 224 is formed between smaller diameter portion 222 and large diameter portion 225 of rod 204.

The rods sandwich a longitudinal core element 226 in the guide slot formed by grooves 208 and 210; core element 226 can slide freely in the slot. This core element has a flat (two-sided) wedge portion 228 on its front end. Wedge portion 228 has opposing lobes 230 and 232. The width of wedge portion 228 exceeds the diameter of the rods in their assembled state. Thus when wedge portion 228 is aligned with holes 216 and 218, its lobes 230, 232 protrude outwardly beyond the peripheries of the rods. The height of these protruding portions is preferably between 0.06 to 1.20 mm.

The rear end of core element 226 has an annular collar 234 of a slightly larger diameter than the front part of the element. The rear end of element 226 behind the collar is threaded at 236. A nut 238 is screwed onto this threaded portion.

A sleeve 240, which has inner threading 242, is screwed onto thread 220 of rod 202. Sleeve 240 has an opening 242*a* in its rear end. The diameter of this opening is smaller than the diameter of annular collar 234, but is larger than external diameter of thread 236.

The bougie shown in FIGS. 14–17, can be used in two different modes.

According to the first mode of operation, core element 226 is not used and thus is removed from the device. After insertion into the urethra, the bougie is expanded to a required diameter by merely rotating sleeve 240 clockwise when seen from the rear end of the device. When sleeve 240 is turned, it will move forward until its front end abuts shoulder 224. Rod 204, which has no engagement with inner thread 242 of sleeve 240, will remain stationary whereas rod 202 will be pulled backward because of engagement of its thread 220 with inner thread 242 of sleeve 240. This causes deformation of rod 204 and hence its expansion outwardly from rod 202. This expansion dilates the urethral stricture or the urethra itself.

In the second mode of operation, the bougie is used in combination with longitudinal core element 226.

First the bougie is assembled so that wedge 228 is aligned with holes 216 and 218 and its lobes 230 and 232 project outward beyond the peripheries of the rods. The bougie is then accurately inserted into the urethra. Until the protruded lobes come into contact with the urethral stricture, the probe can be easily moved forward. The moment of contact of lobes 230, 232 with the stricture can be distinctly felt by the urologist and this will be a signal that the expansion operation should be commenced.

To this end, sleeve 240 is manually rotated. Since sleeve 240 is engaged with threads 220, sleeve 240 will move axially toward the front end of the bougie. Since the inner rear shoulder of sleeve 240 engaged shoulder 234 of core element 226, axial movement of sleeve 240 will be transmitted to core element 224 which will thereupon move forward with respect to rods 202 and 204. Core element 226 is guided in slot 226. Its lobes 230 and 232 will engage the edges of holes 216 and 218 and thus cause rods 202 and 204 to expand outwardly because of the camming action of lobes 230 and 232. Expansion will take place because grooves 208 and 210 have a smaller depth at the front part of the probe, i.e., before the holes, and because of the wedging action of the core.

If difficulties occur in returning the core element to its initial position before extraction of the bougie from the urethra, nut 238 can be used as an auxiliary means to facilitate the return of the core element to its initial position.

SYNOPSIS

The present invention provides bougies with mechanically-expandable probes for treating diseases, especially in the urethra and the neck of the urinary bladder. It is efficient in operation, universal in use, simple to manufacture, and easy to control. Since it has a diameter corresponding to the thinnest bougie of a conventional set, it can be inserted with minimized pain into the urethra.

The bougie can be used to provide vibrational and massaging actions for structures and other diseased portions of the urethra and surrounding tissue. This is very desirable for reducing lesions, making it even possible to treat patients suffering from impotence or other related diseases. This was impossible with conventional bougies. Moreover, the chances of complications are greatly reduced since the bougie of the invention will have far less tendency to traumatize the urethra.

It is obvious that many other modifications of the mechanically-driven bougie of the present invention are possible. For example, only one of the rods of the actuating unit may be movable. Cam or eccentric-type mechanisms can be used instead of the crank mechanism as shown in the illustrated embodiment. The bougie can be made of materials other than plastic or stainless steel, and cams can be located in the vicinity of the tip or in any other place on the rods. Also, while the bougie has been discussed for use in urological applications, it and other probe-like instruments (also referred to as bougies in the claims) can be used in many other applications, including non-human animals or inanimate objects, where an expandable probe is desired. E.g., the bougie can be used for vascular dilitation in cranial, cardiac, and extremity applications. Also it can be employed in any conduit or duct in mechanical, plumbing, and laboratory applications and the like where constriction, stenosis, or wall fusion of any lumen is encountered. Therefore the scope of the invention should be determined, not by the examples given, but by appended claims and their legal equivalents.

What we claim is:

1. A mechanically-expandable bougie comprising:

a driving means, elongated radially-expandable probe means comprising a pair of adjacent, elongated members attached to said driving means, said driving means having two output elements and being arranged to cause said output elements to reciprocate in mutually-opposite directions, said probe means being arranged to convert the reciprocating motions of said output elements of said driving means into expansions and contractions of said pair of elongated members, said elongated members comprising a pair of rods connected to each other at one end thereof and having semicircular cross sections so that when one rod is placed adjacent the other, they will form a complete circle in cross section, the ends of said rods opposite to said one end thereof being provided with means for attachment to said respective output elements of said driving means.

2. An instrument according to claim 1 wherein said driving means comprises reciprocating means composed of two elements which reciprocate simultaneously in mutually opposite directions, said means for attachment comprising fastener means for connecting one of said reciprocating elements to one of said rods and another of said reciprocating elements to another of said rods, whereby during reciprocation of said elements, the portions of said rods in the vicinity of said one end thereof are bent outwardly in alternating manner, thereby expanding and contracting said one end of said probe means.

3. An instrument according to claim 1 wherein the edges of said rods at the mating surfaces thereof are chamfered to prevent pinching when said probe is used in a urethra or other bodily duct.

4. An instrument according to claim 1 wherein said means for attachment means comprises threaded holes in said rods, through holes in said reciprocating elements, and threaded fasteners for mating with said threaded holes for said rods to said respective reciprocating elements.

5. An instrument according to claim 1 wherein said rods are made of stainless steel.

6. An instrument according to claim 1 where said rods are made of plastic.

7. An instrument according to claim 1 wherein said pair of adjacent elongated members have a diameter which gradually decreases towards the end of said elongated members distal from said driving means.

8. A mechanically-driven, hand-holdable instrument for use within the lumen of any conduit, comprising: a driving housing; a pair of sliding elements movable with respect to each other and guided in said housing, one end of each of said sliding elements protruding outside said housing; a probe formed by a pair of flexible rods connected together at one end thereof and removably attachable at the other end thereof to said respective sliding elements by attaching means, and means in said housing for causing said sliding elements to reciprocate, whereby reciprocation of said sliding elements causes alternating bending of said rods in opposite directions and hence radial expansions and contractions of said probe.

9. An instrument according to claim 8 wherein said rods have a semicircular cross-section so that when said rods are placed adjacent each other, they will form a complete circle in cross-section.

10. An instrument according to claim 8 wherein said probe has a straight and a curved portions, a circular cross section, and a diameter which gradually decreases towards the tip of said probe.

11. An instrument according to claim 8 wherein edges of said rods on mating surfaces thereof are chamfered, whereby pinching of the urethral mucosa in a lumen is prevented.

12. An instrument according to claim 8 further including means for adjusting the speed of the reciprocations of said sliding elements.

* * * * *